US008716615B2

(12) United States Patent
Fukuyama et al.

(10) Patent No.: US 8,716,615 B2
(45) Date of Patent: May 6, 2014

(54) CONDUCTION BREAKING DEVICE

(75) Inventors: Takaki Fukuyama, Kiyosu (JP); Kenji Shibayama, Kiyosu (JP); Yasushi Okada, Kiyosu (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 286 days.

(21) Appl. No.: 13/358,724

(22) Filed: Jan. 26, 2012

(65) Prior Publication Data

US 2012/0194954 A1 Aug. 2, 2012

(30) Foreign Application Priority Data

Jan. 28, 2011 (JP) ..... 2011-016608

(51) Int. Cl.
*H01H 85/00* (2006.01)

(52) U.S. Cl.
USPC ..... 200/61.08

(58) Field of Classification Search
USPC ..... 200/61.08, 151, 306; 337/157–159, 337/401–409; 89/1.14; 264/84; 137/68.13; 83/639.4; 361/62
See application file for complete search history.

(56) References Cited

U.S. PATENT DOCUMENTS

| | | | | |
|---|---|---|---|---|
| 5,757,150 | A | 5/1998 | Kinoshita et al. | |
| 5,990,572 | A | 11/1999 | Yasukuni et al. | |
| 7,078,635 | B2 | 7/2006 | Kordel et al. | |
| 7,239,225 | B2 * | 7/2007 | Tirmizi | 337/30 |
| 7,498,923 | B2 * | 3/2009 | Iversen | 337/165 |
| 8,432,246 | B2 * | 4/2013 | Suzuki et al. | 337/157 |
| 2005/0073387 | A1 | 4/2005 | Kordel et al. | |

FOREIGN PATENT DOCUMENTS

| | | | |
|---|---|---|---|
| JP | 07-059202 | A | 3/1995 |
| JP | 10-241524 | A | 9/1998 |
| JP | A-2004-306946 | | 11/2004 |
| JP | 2005-019411 | A | 1/2005 |

OTHER PUBLICATIONS

Office Action mailed Jan. 7, 2014 issued in corresponding JP patent application No. 2011-016608.

* cited by examiner

*Primary Examiner* — Edwin A. Leon
(74) *Attorney, Agent, or Firm* — Posz Law Group, PLC

(57) ABSTRACT

A conduction breaking device includes a movable member accommodated in an accommodation chamber of a case. A cutter portion projects from an advancing side of the movable member in the moving direction. A gas generator is arranged on the trailing side of the movable member in the moving direction. A conduction member extends to connect a pair of external connection portions and includes a pair of base portions and a breakable portion. The base portions are located in the side wall of the case and extend along the moving direction of the movable member. The breakable portion is shaped to connect the base portions to each other and to block the advancing side of the movable member in the moving direction. Step portions are formed in the breakable portion. Engaging portions that are engageable with the step portions are formed in the case.

9 Claims, 6 Drawing Sheets

CONDUCTION BREAKING DEVICE

BACKGROUND OF THE INVENTION

The present invention relates to a conduction breaking device that breaks conduction between electrical devices through cutting of a conduction member with a cutter portion.

Conventionally, for example, Japanese Laid-Open Patent Publication No. 2004-306946 discloses a conduction breaking device. The conduction breaking device is placed between electrical devices. When an abnormality occurs in the electrical devices, the conduction breaking device is activated to break the conduction between the electrical devices.

FIG. 12 illustrates one such conduction breaking device. As shown in FIG. 12, an accommodation chamber 102 is defined in a case 101. A movable member 103 is movably accommodated in the accommodation chamber 102. The movable member 103 has a protruding cutter portion 104, which is located on the advancing side with respect to the moving direction of the movable member 103, that is, the direction indicated by the arrow in the drawing. A gas generator 105 is arranged in the accommodation chamber 102 at a position on the trailing side of the moving direction of the movable member 103. The gas generator 105 is activated when receiving a signal from the outside and generates gas.

A conduction member 106 for connecting electrical devices is formed by a thin plate made of a material having high electrical conductivity such as copper. The conduction member 106 includes a pair of base portions 107A, 107B and a breakable portion 108 connecting the base portions 107A, 107B to each other. The base portions 107A, 107B are each formed to extend along the moving direction of the movable member 103 in a side wall of the case 101. Also, the base portions 107A, 107B are connected to external connection portions 109A, 109B exposed to the outside of the case 101, respectively. The external connection portions 109A, 109B are parts that are connected to electrical devices. The breakable portion 108 extends in the accommodation chamber 102, blocking the advancing side of the movable member 103 in the moving direction of the movable member 103.

The conduction breaking device operates in the following manner. First, when an activation signal is input to the gas generator 105, the gas generator 105 generates gas. The generated gas pushes the movable member 103 toward the breakable portion 108 of the conduction member 106. Thereafter, the distal end of the cutter portion 104 of the movable member 103 strikes and cuts the breakable portion 108. As a result, the conduction member 106 is cut to break the conduction between the external connection portions 109A and 109B, so that conduction between the electrical devices is broken.

When the above described conduction breaking device is activated, the cutter portion 104 presses and cuts the breakable portion 108 of the conduction member 106, or a thin-plate like conductive body. Therefore, during operation of the conduction breaking device, the breakable portion 108 is inevitably stretched by pressing motion of the cutter portion 104 before being broken. Therefore, to reliably break the conduction between electrical devices by ensuring a sufficient distance between the endings of broken parts after the breakable portion 108 is broken, the amount of movement of the cutter portion 104 during operation is preferably set to a sufficiently great value, taking into consideration the amount of stretching of the breakable portion 108. However, if the movement amount of the cutter portion 104 is simply increased, the size of the conduction breaking device is increased, accordingly. This in turn enlarges the space for installing the device and increases the manufacturing costs.

SUMMARY OF THE INVENTION

Accordingly, it is an objective of the present invention to provide a conduction breaking device that is capable of reliably breaking conduction without increasing the size.

To achieve the foregoing objective and in accordance with a first aspect of the present invention, a conduction breaking device is provided that includes a case having a side wall, an accommodation chamber formed in the case, a movable member, a cutter portion, a gas generator, and a conduction member. The movable member is accommodated in the accommodation chamber to be movable in a moving direction. The cutter portion is provided on the movable member. The cutter portion projects from a leading side of the movable member. The gas generator is arranged in the accommodation chamber and on the trailing side of the movable member. The gas generator generates gas in response to input of an activation signal. The conduction member has a pair of external connection portions, and extends to connect the external connection portions to each other. The conduction member includes a pair of base portions and a breakable portion. The base portions are provided in the side wall of the case, and extend in the moving direction of the movable member and being connected to the pair of external connection portions, respectively. The breakable portion connects the base portions to each other and extends in the accommodation chamber to interfere with the advancing side of the movable member. The conduction breaking device further includes at least one step portion that is formed into a stepped shape in the breakable portion and at least one engaging portion provided in the case, wherein the engaging portion shaped to engage with the at least one step portion.

In accordance with a second aspect of the present invention, a conduction breaking device is provided that includes a case, an accommodation chamber formed in the case, a movable member that is accommodated in the accommodation chamber to be movable in a moving direction, a cutter portion, a gas generator, and a conduction member. The cutter portion is provided on the movable member, and projects from a leading side of the movable member. The gas generator is arranged in the accommodation chamber and on the trailing side of the movable member. The gas generator generates gas in response to input of an activation signal. The conduction member has a pair of external connection portions, and connects the external connection portions to each other and extending in the accommodation chamber to interfere with the leading side of the movable member. The cutter portion includes a distal portion, a proximal portion, and an outer surface extending between the distal portion and the proximal portion. A protrusion is provided on the outer surface of the cutter portion, the protrusion extending along the direction in which the conduction member extends.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A conduction breaking device 20 according to one embodiment of the present invention will now be described.

Figure 1:
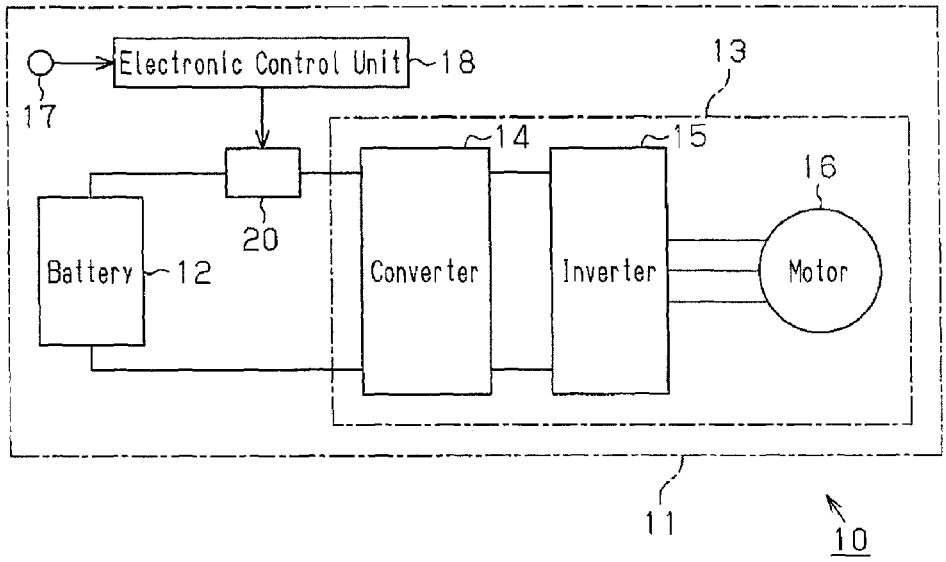
FIG. 1 is a diagram schematically showing an electric circuit to which a conduction breaking device according to one embodiment of the present invention is applied.

As shown in FIG. 1, the conduction breaking device 20 is employed in an electric circuit 11. The electric circuit 11 has a battery 12 and an electrical device 13. In the electric circuit 11, the battery 12 supplies electricity to the electrical device 13, to drive the electrical device 13. The electrical device 13 includes a converter 14, which raises the voltage of the electricity supplied by the battery 12, an inverter 15, which inverts the direct current electricity from the converter 14 to an alternating current electricity, and a motor 16, which is driven by the alternating current electricity from the inverter 15.

The electric circuit 11 is mounted on a vehicle 10. When the vehicle 10 is damaged due to, for example, a collision, the electrical device 13 may fail to operate properly or a current may leak from the electric circuit 11. Thus, the vehicle 10 is equipped with the conduction breaking device 20, which breaks conduction between the battery 12 and the electrical device 13 at such a collision. The conduction breaking device 20 is located between the battery 12, specifically, its positive terminal, and the electrical device 13 in the electric circuit 11. The vehicle 10 has a collision sensor 17 for detecting whether there is a collision and an electronic control unit 18, which is constructed with a microcomputer as a dominant constituent. The electronic control unit 18 receives output signals from the collision sensor 17. When detecting a collision based on an output signal from the collision sensor 17, the electronic control unit 18 activates the conduction breaking device 20. This stops supply of electricity from the battery 12 to the electrical device 13.

The configuration of the conduction breaking device 20 will now be described.

Figure 2:
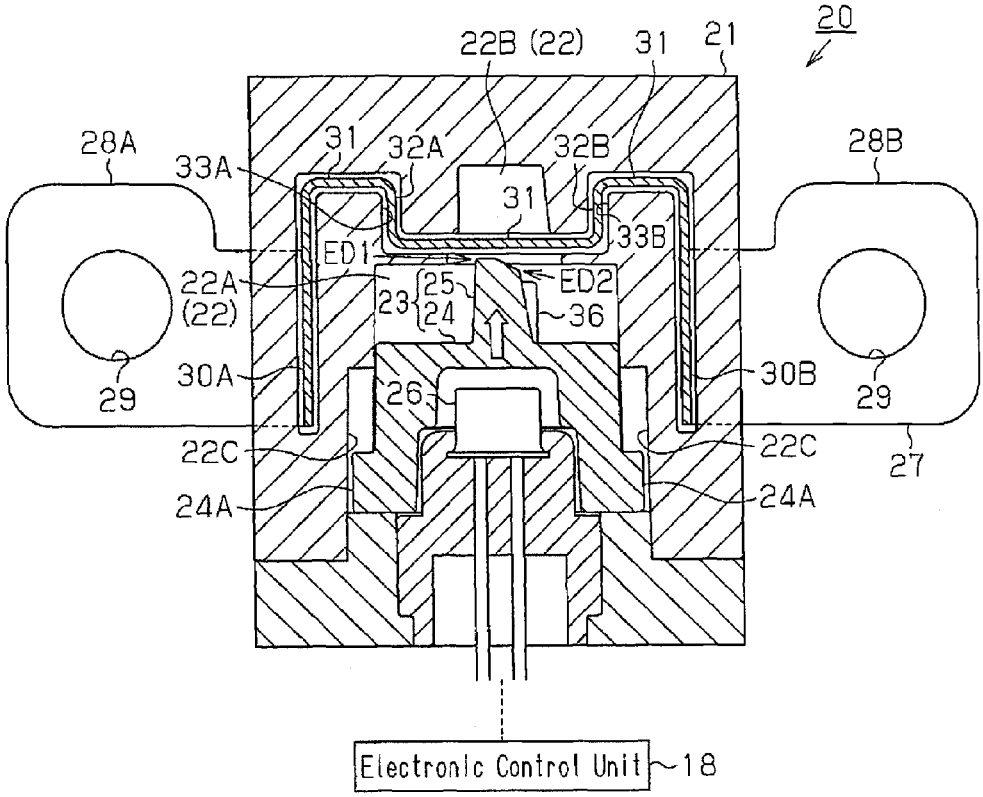
FIG. 2 is a cross-sectional view illustrating the internal structure of the conduction breaking device shown in FIG. 1.

As shown in FIG. 2, an accommodation chamber 22 is defined in a case 21 of the conduction breaking device 20. The accommodation chamber 22 accommodates a movable member 23, which is movable in a straight line direction, that is, along a direction of the arrow in the drawing. A trailing portion of the movable member 23 in the moving direction, that is, a main body 24, is shaped as a cylinder with a closed upper end. The main body 24 has on the outer circumferential surface two protrusions 24A extending along the moving direction. The main body 24 also has a cutter portion 25 protruding from the advancing side in the moving direction. The cutter portion 25 has a generally trapezoidal cross section as viewed in a direction perpendicular to the moving direction of the movable member 23. The accommodation chamber 22 has a substantially columnar space that has a shape corresponding to the main body 24 (a main chamber 22A) and a space located in the advancing side of the main chamber 22A in the moving direction (a sub-chamber 22B). The sub-chamber 22B receives the cutter portion 25 after the conduction breaking device 20 is activated. The outer circumferential surface of the main body 24 and the inner circumferential surface of a part of the accommodation chamber 22 in which the main body 24 of the movable member 23 moves (specifically, the main chamber 22A) are both reduced in size, or tapered, toward the advancing side of the movable member 23. Also, recesses 22C, which extend along the moving direction of the movable member 23, are formed in the inner surface of the main chamber 22A. The recesses 22C allow the protrusions 24A of the main body 24 to move therein.

An explosive type gas generator 26 is arranged on the trailing side of the movable member 23 in the accommodation chamber 22. The gas generator 26 is connected to the electronic control unit 18. At activation of the conduction breaking device 20, the gas generator 26 receives an activation signal from the electronic control unit 18, specifically, a signal for causing the gas generator 26 to generate combustion gas. When receiving a signal from the electronic control unit 18, the gas generator 26 inflates the incorporated explosive to generate combustion gas.

The conduction breaking device 20 has a conduction member 27 for connecting electrical devices to each other. The conduction member 27 is formed by a thin plate made of a material having high electrical conductivity, specifically, copper. The conduction member 27 is attached to the case 21 with its both ends exposed to the outside. In the conduction breaking device 20, the ends of the conduction member 27 function as external connection portions 28A, 28B connected to electrical devices. In this embodiment, the electrical devices include the battery 12 and the converter 14. The conduction member 27 extends between to the external connection portions 28A, 28B. The external connection portions 28A, 28B each have a through hole 29.

In the conduction breaking device 20, using the through holes 29 and with fastening members such as screws, one of the external connection portions 28A, 28B is connected to a terminal of the electric circuit 11 (FIG. 1) that is connected the battery 12, and the other external connection portion is connected to the electrical device 13 in the electric circuit 11, specifically, to a terminal connected to the converter 14. The external connection portions 28A, 28B of the conduction member 27 are each connected to terminals of the electric circuit 11, so that the terminals of the electric circuit 11 are connected to each other via the conduction member 27.

In addition to the external connection portions 28A, 28B, the conduction member 27 (FIG. 2) includes a pair of base portions 30A, 30B and a breakable portion 31 connecting the base portions 30A, 30B. The base portions 30A, 30B are each formed to extend along the moving direction of the movable member 23 in a side wall of the case 21. Also, the base portions 30A, 30B are connected to the external connection portions 28A, 28B, respectively. The breakable portion 31 extends in the accommodation chamber 22, blocking the advancing side of the movable member 23 in the moving direction of the movable member 23.

Figure 3:
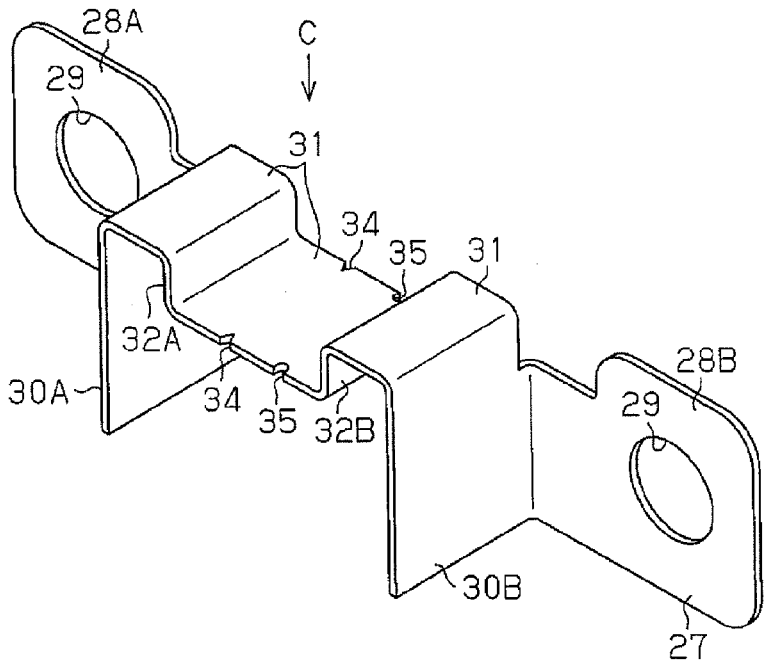
FIG. 3 is a perspective view illustrating the conduction member.

FIG. 3 is a perspective view of the conduction member 27.

As shown in FIGS. 2 and 3, the breakable portion 31 of the conduction member 27 has step portions 32A, 32B, which are formed to have a stepped shape by bending a center portion in the extending direction, that is, in the left-right direction as viewed in FIG. 2. The bending angles of the step portions 32A, 32B, specifically, the angle defined by the sections on both sides of the step portions 32A, 32B in the breakable portion 31 is set to 90°. The step portions 32A, 32B of the breakable portion 31 are formed such that a part between the step portions 32A, 32B (a first portion) is located on the trailing side of the remaining portions (second portion) with respect to the moving direction of the movable member 23 (FIG. 2). The case 21 also includes an engaging portion 33A engaged with the step portion 32A and an engaging portion 33B engaged with the step portion 32B. In this embodiment, the engaging portion 33A, 33B are grooves that extend along the step portion 32A and the step portion 32B and have shapes to receive the whole step portion 32A and the whole step portion 32B, respectively. In this embodiment, the sub-chamber 22B of the accommodation chamber 22 is sandwiched between the step portions 32A and 32B and between the engaging portions 33A and 33B.

Figure 4:
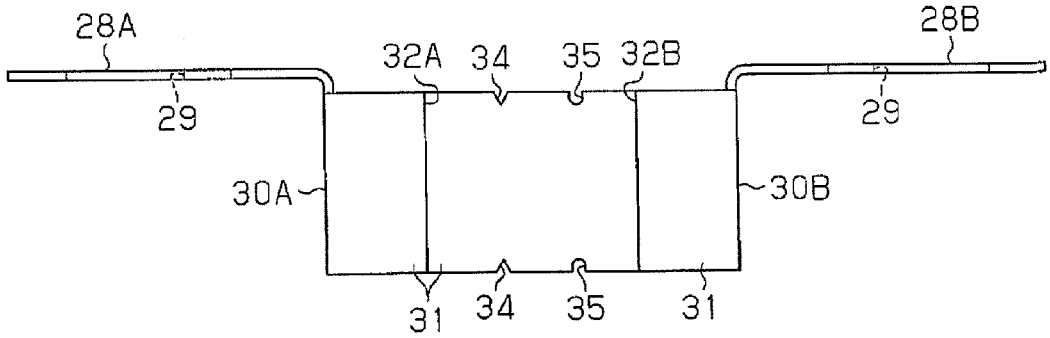
FIG. 4 is a plan view showing the conduction member of FIG. 3, as viewed in the direction of arrow C.

FIG. 4 is a plan view illustrating the conduction member 27 as viewed along arrow C in FIG. 3.

As shown in FIGS. 2 to 4, at a position in the breakable portion 31 of the conduction member 27 where an edge ED1 of the distal end of the cutter portion 25 strikes the breakable portion 31 when the movable member 23 is moved, triangular cutout portions 34 are formed on both sides in the widthwise direction. When the distal edge ED1 of the cutter portion 25 strikes the breakable portion 31, the cutout portions 34 allow stress to be concentrated at the pointed corners thereof. Accordingly, the breakable portion 31 is broken from the pointed corners of the cutout portions 34 so that a crack connects the cutout portions 34. Therefore, the breakable portion 31 can be easily broken at a desired position.

Also, at a position in the breakable portion 31 where an edge ED2 of the distal end of the cutter portion 25 strikes the breakable portion 31 when the movable member 23 is moved, semi-circular cutout portions 35 are formed on both sides in the widthwise direction. The cutout portions 35 have no pointed corners. Thus, unlike the cutout portions 34, stress is unlikely to concentrate when the distal end of the cutter portion 25 strikes the breakable portion 31. However, the cutout portions 35 formed in the breakable portion 31 lower the strength of the corresponding part compared to parts surrounding the cutout portions 35. Thus, when the distal end of the cutter portion 25 strikes the breakable portion 31, the breakable portion 31 is easily bent in a part where the cutout portions 35 are formed.

Figure 5:
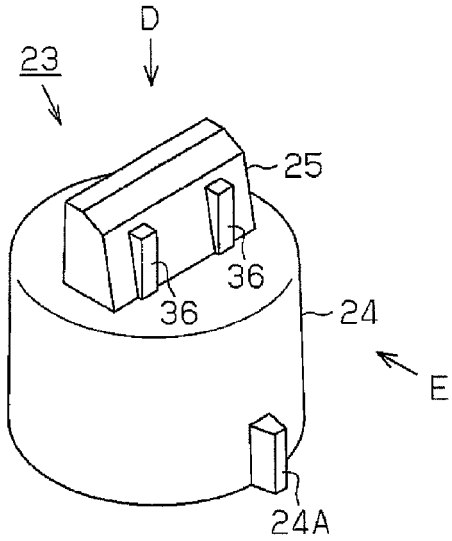
FIG. 5 is a perspective view showing the movable member.
Figure 6A:
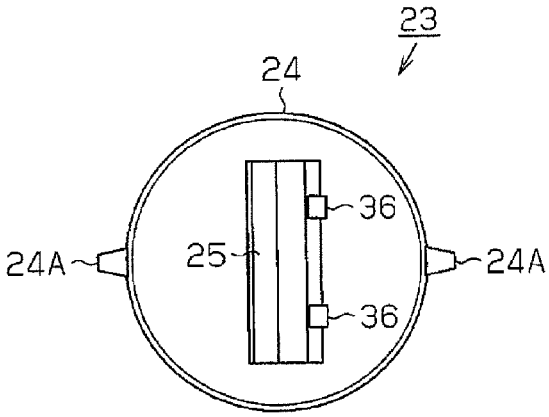
FIG. 6A is a plan view showing the movable member.
Figure 6B:
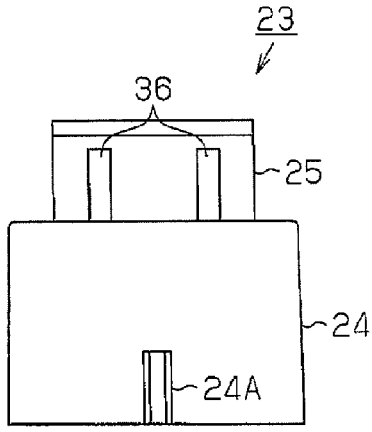
FIG. 6B is a side view showing the movable member.

FIGS. 5, 6A and 6B show the movable member 23. FIG. 6A is a plan view illustrating the movable member 23 as viewed along arrow D in FIG. 5, and FIG. 6B is a side view of the movable member 23 as viewed along arrow E in FIG. 5.

As shown in FIGS. 5, 6A and 6B, the movable member 23 includes the substantially columnar main body 24 and the cutter portion 25 projecting from the main body 24. As described above, the cutter portion 25 is shaped as a plate having a generally trapezoidal cross section. Specifically, the cutter portion 25 becomes thinner toward the distal end. The cutter portion 25 has two protrusions 36 on the outer surface. The protrusions 36 protrude in a direction in which the breakable portion 31 extends (refer to FIG. 2), that is, in the left-right direction in FIG. 6A. Each protrusion 36 extends in a straight line along the moving direction of the cutter portion 25 from the proximal end of the cutter portion 25, or an end adjacent to the main body 24, to a position close to the distal portion. That is, the height of the protrusions 36 is slightly less than the height of the cutter portion 25. The two protrusions 36 are arranged with a space in between. The movable member 23, which is formed by the main body 24, the cutter portion 25, and the two protrusions 36, is an integral component made of a synthetic resin.

In the present embodiment, even though the protrusions 36 are formed on the outer surface of the cutter portion 25 of the movable member 23, the protrusions 36 are shaped such that, when the cutter portion 25 is formed by molding synthetic resin, the molded cutter portion 25 is easily removed from the mold. Therefore, the movable member 23 can be formed easily by using a mold with a simple structure.

Operation achieved by employing the conduction breaking device 20 according to this embodiment will now be described.

First, with the conduction breaking device 20 in a non-operating state (the state shown in FIG. 2), when the electronic control unit 18 supplies an activation signal to the gas generator 26, the gas generator 26 is activated and generates combustion gas. The generated gas pushes the movable member 23 toward the breakable portion 31 of the conduction member 27. At this time, the protrusions 24A formed on the main body 24 of the movable member 23 move within the recesses 22C formed in the main chamber 22A of the case 21. In this embodiment, the gas generator 26 of an explosive type is used as the drive source of the conduction breaking device 20. Compared to devices that employ other types of drive source such as an electromagnetic drive source, devices that are driven by the gas generator 26 of an explosive type can generally be quickly activated, are less expensive, and have a higher reliability. In this embodiment, such an explosive type is used as the drive source to drive the conduction breaking device 20.

Thereafter, when the distal end of the cutter portion 25 of the movable member 23 strikes the breakable portion 31, the pressing force of the cutter portion 25 causes stress to be concentrated on the pointed corner of the cutout portions 34 of the breakable portion 31. Accordingly, the breakable portion 31 is broken along the straight line connecting the pointed corners of the cutout portions 34. At this time, the pressing force of the cutter portion 25 bends the breakable portion 31 in a part close to a part where the cutout portions 35 are formed.

Figure 7:
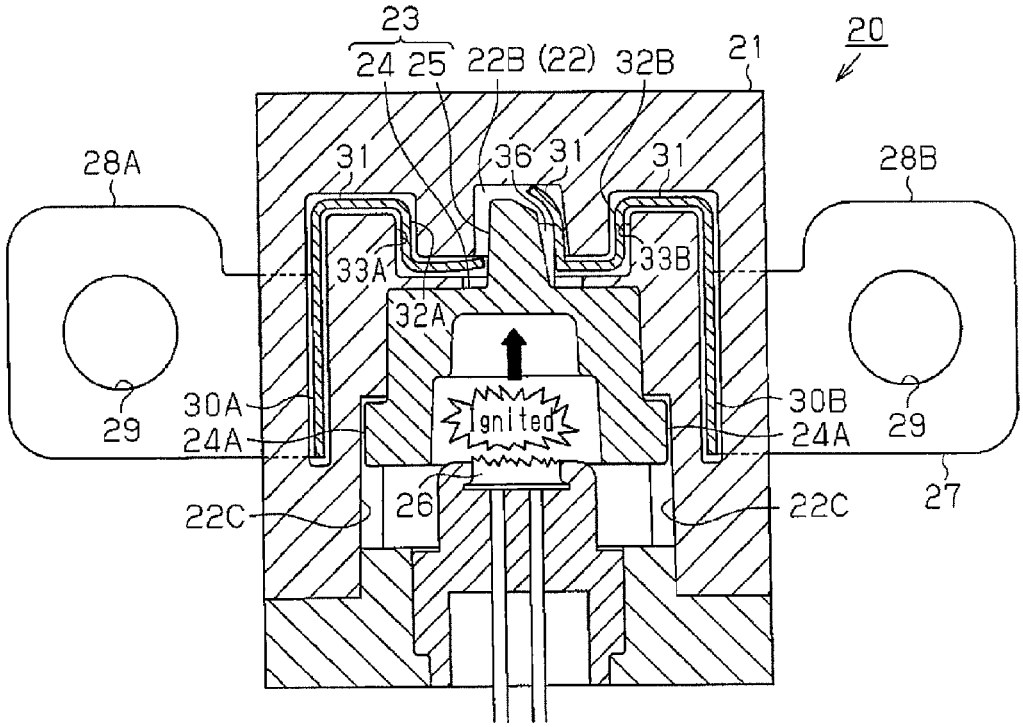
FIG. 7 is a cross-sectional view showing the internal structure of the conduction breaking device after activated.

As a result, the conduction member 27 is cut, and the conduction between the external connection portions 28A, 28B is broken (the state shown in FIG. 7). This in turn breaks the conduction between the battery 12 (see FIG. 1) and the converter 14. FIG. 7 is a cross-sectional view showing the internal structure of the conduction breaking device 20 after activated.

As described above, in the conduction breaking device 20, the inner circumferential surface of the accommodation chamber 22 and the outer circumferential surface of the main body 24 of the movable member 23 are both tapered toward the advancing side in the moving direction of the movable member 23. Therefore, when the movable member 23 is moved due to generation of gas by the gas generator 26 in the conduction breaking device 20, the main body 24 of the movable member 23 is fitted into a part of the accommodation chamber 22 that is on the advancing side in the moving direction.

At this time, the moving direction of the main body 24 of the movable member 23 is adjusted by contact between the outer circumferential surface of the main body 24 and the inner circumferential surface of the accommodation chamber 22, so that the movable member 23, specifically, the cutter portion 25, is moved while being guided to a proper position. Accordingly, the conduction breaking device 20 is properly operates such that the cutter portion 25 cuts the breakable portion 31 in a planned manner.

After the operation of the conduction breaking device 20, that is, after the main body 24 of the movable member 23 is fitted in a part of the accommodation chamber 22 on the advancing side in the moving direction, the movable member 23 is fixed at this position (the position shown in FIG. 7). If the cutter portion 25 is returned to the original position after pressing and cutting the breakable portion 31, the breakable portion 31, which is elastically deformed, would act to return to the original position. Thus, the cut endings of the breakable portion 31 may undesirably approach each other. In this embodiment, the cutter portion 25 is held between the cut endings after pressing and cutting the breakable portion 31, and the cutter portion 25 does not return to the original position. The cut endings of the breakable portion 31 are thus prevented from approaching each other.

In the conduction breaking device 20, when the breakable portion 31 is pressed by the cutter portion 25 before being broken, the breakable portion 31 is inevitably stretched. Therefore, to reliably break the conduction using the conduction breaking device 20 by ensuring a sufficient distance between the endings of broken parts after the breakable portion 31 is broken, the amount of movement of the cutter portion 25 during operation is preferably set to a sufficiently great value, taking into consideration the amount of stretching of the breakable portion 31. However, if the movement amount of the cutter portion 25 is simply increased, the size of the conduction breaking device 20 is increased, accordingly. This in turn enlarges the space for installing the device and increases the manufacturing costs.

Since the conduction breaking device 20 is used for stop the supply of electricity from the battery 12 to the motor 16 for driving the vehicle 10 to ensure safety at the time of abnormality of the vehicle 10, the stopping must be reliably executed. Therefore, the distance between the cut endings of the conduction member 27 is likely to cause a problem. Further, in recent years, the demands for higher functionality of the vehicle 10 require an increasing number of devices. This has resulted in less vacant space on the vehicle 10. Thus, if the size of the conduction breaking device 20 is increased, it would be difficult to mount the conduction breaking device 20 on the vehicle 10.

Taking the above into consideration, the conduction breaking device 20 has the two step portions 32A, 32B at a middle portion in the extending direction of the breakable portion 31 of the conduction member 27. Also, the step portions 32A, 32B are engaged with the two engaging portions 33A, 33B formed in the case 21, respectively. Therefore, when the breakable portion 31 is pressed and cut by the cutter portion 25, parts of the breakable portion 31 that are farther from the part pressed by the cutter portion 25 than the step portions 32A, 32B are prevented from moving toward the pressed portions. Specifically, only a part of the breakable portion 31 that is located between the step portions 32A, 32B is stretched, and the remaining portions are restricted from being stretched. Therefore, even though the breakable portion 31 is stretched when pressed by the cutter portion 25, only a part of the breakable portion 31 is stretched. Compared to a conventional device that does not have the step portion 32A, 32B or the engaging portion 33A, 33B, and in which the entire breakable portion 31 is stretched, the conduction breaking device 20 of the present embodiment has a shorter amount of stretch of the breakable portion 31. Therefore, the movable member 23, which has the cutter portion 25, is moved by a relatively small amount, so that the size of the conduction breaking device 20 is prevented from being increased. Also, the cut endings of the breakable portion 31 can be sufficiently separated from each other so that conduction breaking is reliably performed by the conduction breaking device 20.

A hypothetical case will be discussed in which the bent portions of the step portions 32A, 32*b* of the breakable portions 31 are bent at obtuse angles. In this case, the greater the set angles, the more likely becomes that the step portions 32A, 32B of the breakable portion 31 are slid relative to the engaging portions 33A, 33B of the case 21 when the breakable portion 31 is pulled in the extending direction. This is highly likely to increase the amount of stretch of the breakable portion 31. In the illustrated embodiment though, the bending angle of each of the step portions 32A, 32B is set to 90°. Thus, when the cutter portion 25 presses the breakable portion 31, the step portions 32A, 32B of the breakable portion 31 are prevented from moving toward the pressed part due to sliding motion along the engaging portions 33A, 33B. This reduces the stretching of the breakable portion 31.

Also, in the conduction breaking device 20, the step portions 32A, 32B are formed such that a part between the step portions 32A, 32B in the breakable portion 31 is located on the trailing side of the remaining portions with respect to the moving direction of the movable member 23. Therefore, after the movable member 23 is moved together with the cutter portion 25 and cuts the breakable portion 31, the cutter portion 25 is received between the two step portions 32A, 32B, more specifically, accommodated in the sub-chamber 22B of the accommodation chamber 22. Thus, compared to a configuration in which, after cutting the breakable portion 31, most of the cutter portion 25 is moved to a position beyond the space between the two step portions 32A, 32B, the space required for moving the cutter portion 25, that is, the length of the accommodation chamber 22 in the moving direction can be reduced. This allows the size of the conduction breaking device 20 to be reduced.

Figure 8:
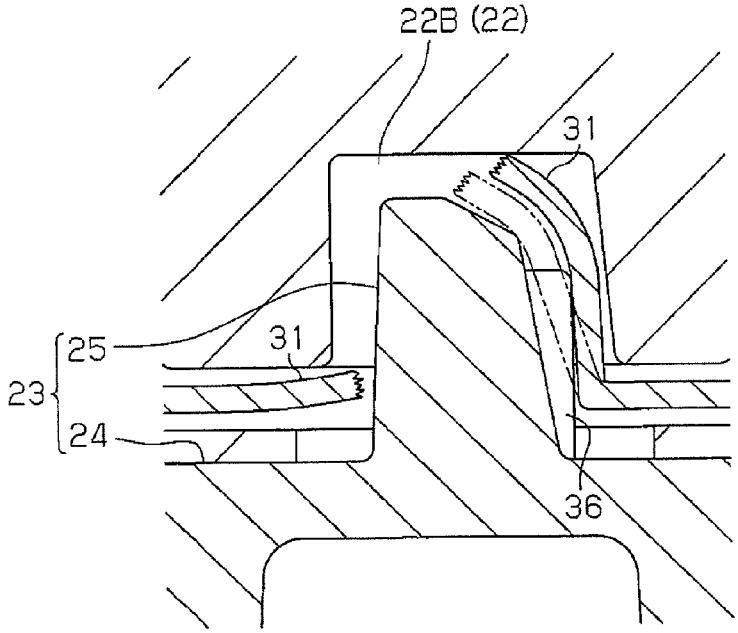
FIG. 8 is an enlarged cross-sectional view of the internal structure of the conduction breaking device after activated, illustrating the cutter portion and its surroundings.

FIG. 8 is an enlarged cross-sectional view of the internal structure of the conduction breaking device 20 after activated, illustrating the cutter portion 25 and its surroundings.

As shown in FIG. 8, after the breakable portion 31 is cut, the cutter portion 25 is moved further upward to push away the cut endings in the above conduction breaking device 20. In the conduction breaking device 20, the cutter portion 25 has the two protrusions 36 on the outer surface, and the protrusions 36 protrude in a direction in which the breakable portion 31 extends between the distal portion and the proximal portion of the cutter portion 25. Thus, after the breakable portion 31 is pressed and cut by the cutter portion 25, the cut endings of the breakable portion 31 are pressed against the inner wall of the sub-chamber 22B by the protrusions 36 of the cutter portion 25.

Accordingly, compared to the amount of deformation of the cut endings of the breakable portion 31 in a case where the cutter portion 25 does not have the protrusions 36 (represented by two-dashed line in FIG. 8), the amount of deformation of the cut endings of the breakable portion 31 in the conduction breaking device 20 of the present embodiment (represented by a solid line in FIG. 8) is increased. Therefore, the breakable portion 31 is bent such that the cut endings thereof are separated from each other. Since the cut endings of the breakable portion 31 are separated by a sufficient distance, the conduction breaking is reliably performed by the conduction breaking device 20.

When forming a resin product using a mold, the dimensional accuracy of the product may deteriorate due to contraction during the cooling process after the molding. To suppress such deterioration of the dimensional accuracy, it is preferable to reduce the amount of resin to decrease the rate of contraction. Also, in the conduction breaking device 20, the movable member 23 is moved in the accommodation chamber 22 while being guided by the inner circumferential surface of the accommodation chamber 22, and the cutter portion 25 of the movable member 23 cuts a predetermined position of the breakable portion 31 of the conduction member 27. Therefore, to achieve the accurate movement of the movable member 23 and the cutting of the breakable portion 31 by the cutter portion 25 at a proper position, it is important to make the movable member 23 with high accuracy.

In this respect, since the protrusions 36 are formed on the outer surface of the cutter portion 25 of the conduction breaking device 20, the protrusions 36 push the cut endings of the breakable portion 31 after being broken so that the distance between the cut endings increases. The protrusions 36 also allow the cutter portion 25 to be thinner. Therefore, the rate of contraction after the movable member 23 is molded and then cooled is suppressed. This increases the dimension accuracy of the movable member 23.

As described above, the preferred embodiment has the following advantages.

(1) The step portions 32A, 32B having a stepped shape are formed at a middle portion in the extending direction of the breakable portion 31 of the conduction member 27. Also, the case 21 has the engaging portions 33A, 33B, which are engageable with the step portions 32A, 32B. Therefore, even though the breakable portion 31 is stretched when pressed by the cutter portion 25, only a part of the breakable portion 31 is stretched. Therefore, compared to a conventional device that does not have the step portion 32A, 32B or the engaging portion 33A, 33B, and in which the entire breakable portion 31 is stretched, the amount of stretch of the breakable portion 31 can be shortened. Therefore, the movable member 23, which has the cutter portion 25, is moved by a relatively small amount, so that the size of the conduction breaking device 20 is prevented from being increased. Also, the cut endings of the breakable portion 31 can be sufficiently separated from each other so that conduction breaking is reliably performed by the conduction breaking device 20.

(2) The two step portions 32A, 32B and the two engaging portions 33A, 33B are formed, and the cutter portion 25 of the movable member 23 is at a position to cut a part of the breakable portion 31 that is between the two step portions 32A, 32B. Therefore, when the cutter portion 25 presses the breakable portion 31, only a part of the breakable portion 31 that is held between the two step portions 32A, 32B is stretched. Thus, the length of a part of the breakable portion 31 that is stretched is reduced, so that the amount of stretch of the breakable portion 31 is decreased. This prevents the size of the conduction breaking device 20 from being increased.

(3) The step portions 32A, 32B are formed such that a part between the step portions 32A, 32B in the breakable portion 31 is located on the trailing side of the remaining portions with respect to the moving direction of the movable member 23. Thus, compared to a configuration in which, after cutting the breakable portion 31, most of the cutter portion 25 is moved to a position beyond the space between the two step portions 32A, 32B, the space required for moving the cutter portion 25, that is, the length in the moving direction can be reduced. This allows the size of the conduction breaking device 20 to be reduced.

(4) The cutter portion 25 has the pair of protrusions 36 on the outer surface, and the protrusions 36 protrude in a direction in which the breakable portion 31 extends between the distal portion and the proximal portion of the cutter portion 25. Thus, after the breakable portion 31 is pressed and cut by the cutter portion 25, the cut endings of the breakable portion 31 are pressed against the inner wall of the sub-chamber 22B by the protrusions 36 of the cutter portion 25. Since the cut endings of the breakable portion 31 are separated by a sufficient distance, the conduction breaking is reliably performed by the conduction breaking device 20.

(5) The cutter portion 25 is shaped as a plate made of a synthetic resin and becomes thinner toward the distal end. The protrusions 36 are formed integrally with the cutter portions 25. The protrusions 36 extend in a straight line along the moving direction of the movable member 23. Thus, even though the protrusions 36 are formed on the outer surface of the cutter portion 25 of the movable member 23, the protrusions 36 are shaped such that, when the cutter portion 25 is formed by molding synthetic resin, the molded cutter portion 25 is easily removed from the mold. Therefore, the movable member 23 can be formed easily by using a mold with a simple structure.

The above described embodiment may be modified as follows.

One or both of the inner circumferential surface of the accommodation chamber 22 and the outer circumferential surface of the main body 24 of the movable member 23 may have a shape other than a shape tapered toward the advancing end of the movable member 23 in the moving direction. For example, the inner diameter of the accommodation chamber 22 may be constant along the moving direction of the movable member 23, and the outer diameter of the movable member 23 may be constant along the moving direction of the movable member 23.

The bending angle of the step portions 32A, 32B, which are formed in the breakable portion 31 of the conduction member 27, is not limited to 90°, but may be an angle smaller than 90°. In such a case also, when the cutter portion 25 presses the breakable portion 31, the step portions 32A, 32B of the breakable portion 31 are prevented from moving toward the pressed parts due to sliding motion along the engaging portions 33A, 33B. Further, as long as the step portions 32A, 32B are reliably prevented from moving toward the pressed part, the bending angles of the step portions 32A, 32B may be greater than 90°.

The engaging portions 33A, 33B do not necessarily have grooves in which the step portions 32A, 32B are entirely embedded. Instead, the engaging portions 33A, 33B may have grooves to partly receive the step portions 32A, 32B.

Instead of grooves in the case 21, the engaging portions 33A, 33B may have on the case 21 protrusions having shapes to be engaged with the step portions 32A, 32B. In this case, the protrusions function as engaging portions.

Instead of providing the engaging portions to be engaged with the step portions 32A, 32B as the ones integrally formed with the case 21, separate members that are attached to the case 21 may be used.

Instead of forming the cutout portions 34, 35 in the breakable portion 31 of the conduction member 27, through holes may be formed. In this case, the through holes preferably have shapes with pointed corners, so that stress generated when the cutter portion 25 presses the breakable portion 31 concentrates at the pointed corners, and the breaking of the breakable portion 31 starts easily from there. Further, if the formed through holes have no pointed corners, the breakable portion 31 is easily folded at a part where such holes are formed.

The cutout portions 34 may be omitted. Also, the cutout portions 35 may be omitted.

The number of the protrusions 36 on the cutter portion 25 is not limited to two. Only one or more than two protrusions 36 may be formed.

Instead of forming protrusions 36 on only one side of the cutter portion 25, protrusions 36 may be formed on a plurality of sides of the cutter portion 25.

Figure 9A:
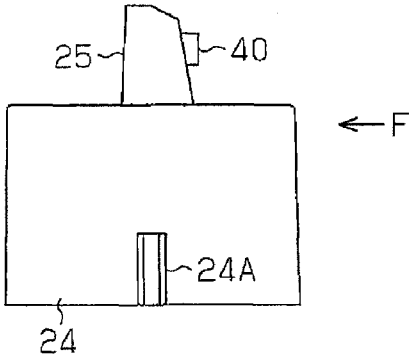
FIGS. 9A and 9B are side views showing movable members of modified embodiments.
Figure 9B:
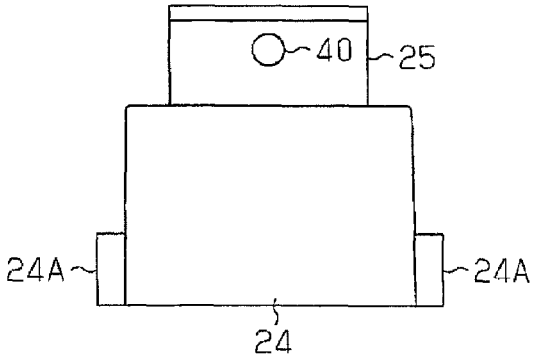

In the above embodiment, the protrusions 36 are formed to extend from the proximal portion to a position close to the distal portion of the cutter portion 25. Instead, as shown in FIGS. 9A and 9B, protrusions 40 located away from the proximal and distal ends of the cutter portion 25 may be formed. FIG. 9B illustrates a side structure of a movable member as viewed in the direction of arrow F in FIG. 9A.

A movable member that does not have the protrusions 36 may be employed.

Figure 10:
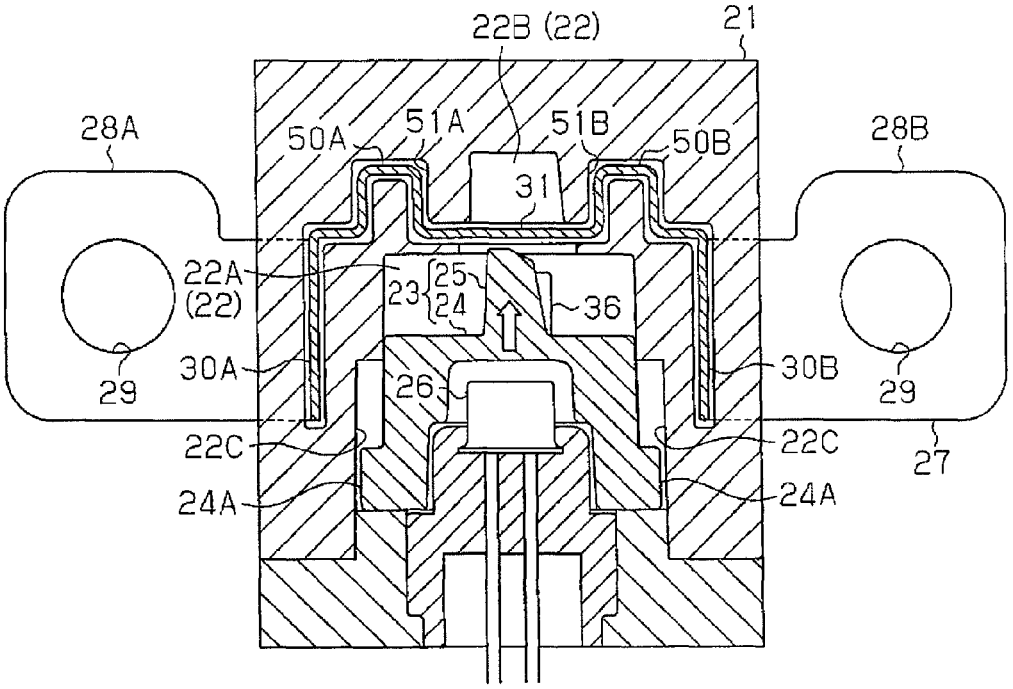
FIG. 10 is a cross-sectional view showing the internal structure of a conduction breaking device according to a modified embodiment.

As shown in FIG. 10, inverted U-shaped parts may be formed as step portions 50A, 50B in the breakable portion 31 of the conduction member 27. Furthermore, step portions may be bent portions having an inverted V shape or an inverted U shape. In these cases, the case 21 has engaging portions 51A, 51B in the case of FIG. 10 that correspond to the shape of the steps 50A, 50B.

Figure 11:
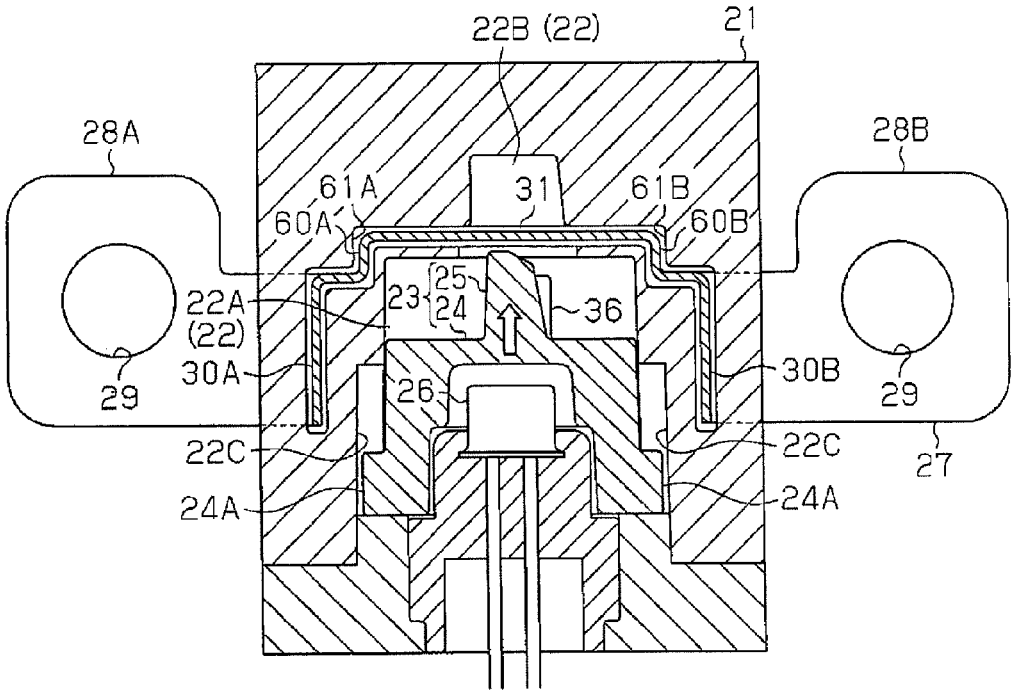
FIG. 11 is a cross-sectional view showing the internal structure of a conduction breaking device according to another modified embodiment.
Figure 12:
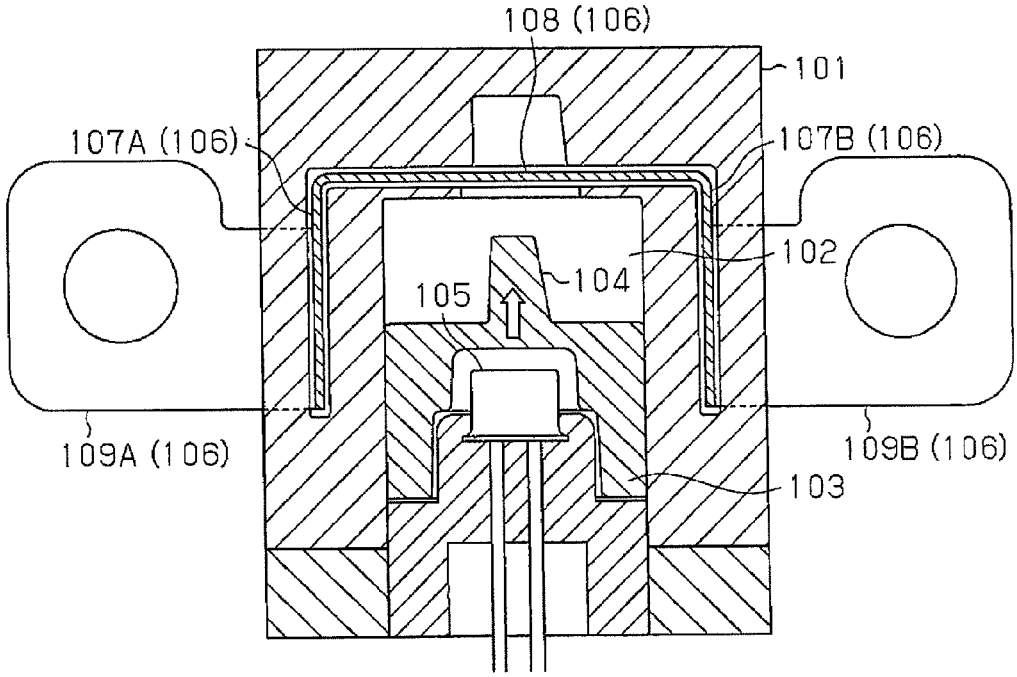
Fig.12 (Prior Art)
FIG. 12 is a cross-sectional view showing the internal structure of a conventional conduction breaking device.

As shown in FIG. 11, the two step portions 60A, 60B may be shaped such that a part of the breakable portion 31 that is between the step portions 60A, 60B is farther from the movable member 23 than the remaining parts of the breakable portion 31. In these cases, the case 21 has engaging portions 61A, 61B that correspond to the shape of the steps 60A, 60B.

A step portion and an engaging portion to be engaged with the step portion may be formed at only one position in a breakable portion.

The material for forming the movable member 23, which has the cutter portion 25, is not limited to resin, but may be any material as long as it has a sufficient strength to cut the breakable portion 31 and has an appropriate insulation property. The method for producing the movable member 23 is not limited to a method using a mold, but may be any appropriate method such as cutting.

One of the following configurations (i) and (ii) may be employed.

(i) Step portions are formed in a middle portion of a breakable portion of a conduction member in the extending direction of the breakable portion, and engaging portions engageable with the step portions are formed on a case.

(ii) A cutter portion of a movable member has protrusions on the outer surface between the distal portion and the proximal portion, and the protrusions protrude in a direction in which a breakable portion extends.

The conduction breaking device according to the present invention is not limited to the one provided between a vehicle driving motor and a battery, but may be employed as any device that is located between electrical devices and breaks conduction between the electrical devices. Such conduction breaking devices include a conduction breaking device provided between the fuel cell and the vehicle driving motor in a fuel cell vehicle, a conduction breaking device provided between a power source and an electrical system in a stationary system, and a conduction breaking device provided between electrical devices in a stationary system.

Therefore, the present examples and embodiments are to be considered as illustrative and not restrictive and the invention is not to be limited to the details given herein, but may be modified within the scope and equivalence of the appended claims.

The invention claimed is:

1. A conduction breaking device comprising:

a case having a side wall;

an accommodation chamber formed in the case;

a movable member that is accommodated in the accommodation chamber to be movable in a moving direction;

a cutter portion provided on the movable member, wherein the cutter portion projects from a leading side of the movable member;

a gas generator that is arranged in the accommodation chamber and on the trailing side of the movable member, wherein the gas generator generates gas in response to input of an activation signal; and a conduction member having a pair of external connection portions, the conduction member extending to connect the external connection portions to each other, wherein the conduction member includes:

a pair of base portions provided in the side wall of the case, the base portions extending in the moving direction of the movable member and being connected to the pair of external connection portions, respectively; and a breakable portion that connects the base portions to each other and extends in the accommodation chamber to interfere with the advancing side of the movable member, wherein the conduction breaking device further includes:

at least one step portion that is formed into a stepped shape in the breakable portion; and at least one engaging portion provided in the case, wherein the engaging portion shaped to engage with the at least one step portion.

2. The conduction breaking device according to claim 1, wherein the at least one step portion is one of two step portions, and the at least one engaging portion is one of two engaging portions, the breakable portion includes a first portion located between the two step portions and a second portion that is the remaining part, and the cutter portion is located at a position to cut the first portion of the breakable portion.

3. The conduction breaking device according to claim 2, wherein the two step portions are formed such that the first portion of the breakable portion is located on the trailing side of the second portion.

4. The conduction breaking device according to claim 1, wherein the cutter portion includes a distal portion, a proximal portion, and an outer surface extending between the distal portion and the proximal portion, and a protrusion is provided on the outer surface of the cutter portion, the protrusion extending along the direction in which the breakable portion extends.

5. The conduction breaking device according to claim 4, wherein the cutter portion is made of a synthetic resin and formed as a plate that becomes thinner toward the distal portion, the protrusion being integrally formed with the cutter portion, and the protrusion extends from the proximal portion to a position close to the distal portion of the cutter portion such that the height of the protrusion is less than the height of the cutter portion.

6. The conduction breaking device according to claim 1, wherein the device is located between a motor for driving a vehicle and a battery for supplying electricity to the motor and operates to break the supply of electricity from the battery to the driving motor.

7. A conduction breaking device comprising:

a case;

an accommodation chamber formed in the case;

a movable member that is accommodated in the accommodation chamber to be movable in a moving direction;

a cutter portion provided on the movable member, wherein the cutter portion projects from a leading side of the movable member;

a gas generator that is arranged in the accommodation chamber and on the trailing side of the movable member, wherein the gas generator generates gas in response to input of an activation signal; and a conduction member having a pair of external connection portions, the conduction member connecting the external connection portions to each other and extending in the accommodation chamber to interfere with the leading side of the movable member, wherein the cutter portion includes a distal portion, a proximal portion, and an outer surface extending between the distal portion and the proximal portion, and a protrusion is provided on the outer surface of the cutter portion, the protrusion extending along the direction in which the conduction member extends.

8. The conduction breaking device according to claim 7, wherein the cutter portion is made of a synthetic resin and formed as a plate that becomes thinner toward the distal portion, the protrusion being integrally formed with the cutter portion, and the protrusion extends from the proximal portion to a position close to the distal portion of the cutter portion such that the height of the protrusion is smaller less than the height of the cutter portion.

9. The conduction breaking device according to claim 7, wherein the device is located between a motor for driving a vehicle and a battery for supplying electricity to the motor and operates to break the supply of electricity from the battery to the driving motor.

* * * * *